US007753244B2

(12) United States Patent
Nagata

(10) Patent No.: US 7,753,244 B2
(45) Date of Patent: Jul. 13, 2010

(54) DRIVING TOOL AND MAGAZINE FOR FASTENER

(75) Inventor: Shigeo Nagata, Osaka-fu (JP)

(73) Assignee: Japan Power Fastening Co., Ltd., Toyonaka-shi, Osaka-fu (JP)

( * ) Notice: Subject to any disclaimer, the term of this patent is extended or adjusted under 35 U.S.C. 154(b) by 313 days.

(21) Appl. No.: 11/568,425

(22) PCT Filed: Apr. 27, 2005

(86) PCT No.: PCT/IB2005/001128

§ 371 (c)(1),
(2), (4) Date: Jul. 3, 2008

(87) PCT Pub. No.: WO2005/105384

PCT Pub. Date: Nov. 10, 2005

(65) Prior Publication Data

US 2008/0257932 A1 Oct. 23, 2008

(30) Foreign Application Priority Data

Apr. 30, 2004 (JP) ..... 2004-136415

(51) Int. Cl.
*B25C 1/04* (2006.01)

(52) U.S. Cl. ..... 227/120; 227/136

(58) Field of Classification Search ..... 227/120, 227/135, 136, 130
See application file for complete search history.

(56) References Cited

U.S. PATENT DOCUMENTS 3,198,412 A * 8/1965 Roosa ..... 227/8
3,266,697 A * 8/1966 Fiedler ..... 227/120
3,437,249 A * 4/1969 Baum ..... 227/120
4,197,974 A * 4/1980 Morton et al. ..... 227/8
4,389,012 A * 6/1983 Grikis et al. ..... 227/120
4,624,401 A * 11/1986 Gassner et al. ..... 227/125
5,975,399 A 11/1999 Oehri
6,199,739 B1 * 3/2001 Mukoyama et al. ..... 227/8
6,499,642 B1 * 12/2002 Amada ..... 227/119
6,592,014 B2 * 7/2003 Smolinski ..... 227/8
6,629,360 B2 * 10/2003 Ohuchi ..... 29/812.5
6,679,412 B1 1/2004 Thomas
6,772,931 B2 * 8/2004 Miller et al. ..... 227/120
6,966,476 B2 * 11/2005 Jalbert et al. ..... 227/8
7,299,959 B2 * 11/2007 Ishizawa et al. ..... 227/120

* cited by examiner

*Primary Examiner*—Scott A. Smith
(74) *Attorney, Agent, or Firm*—Lowe Hauptman Ham & Berner, LLP

(57) ABSTRACT

To upgrade the practicability of the feed of a nail connecting body in a magazine by using a spring. The magazine (4) is provided with (a) a rectilinear loading part (13) which loads the nail connecting body N; and (b) a feed member (34) which is loaded on this rectilinear loading part (13) so that it can slide easily. The feed member (34) is provided with (c) a slider (35) which makes up the main body; and (d) a feed pawl (43). The feed pawl (43) is attached to the slider (35) by the pin (42) so that it can turn freely and so that it can latch onto and be detached from the nail connecting body N and it is energized by the dual purpose compression torsion spring (46) at a latching position. The feel pawl (43) can be latched onto any nail n of the nail connecting body N. As a result, nail connecting bodies N can be added and nail connecting bodies N with a connection which is longer than the motion stroke of the feed member (34) can be used so that the applicability of the nail driving device can be significantly upgraded.

3 Claims, 9 Drawing Sheets

DRIVING TOOL AND MAGAZINE FOR FASTENER

RELATED APPLICATIONS

Figure 1:
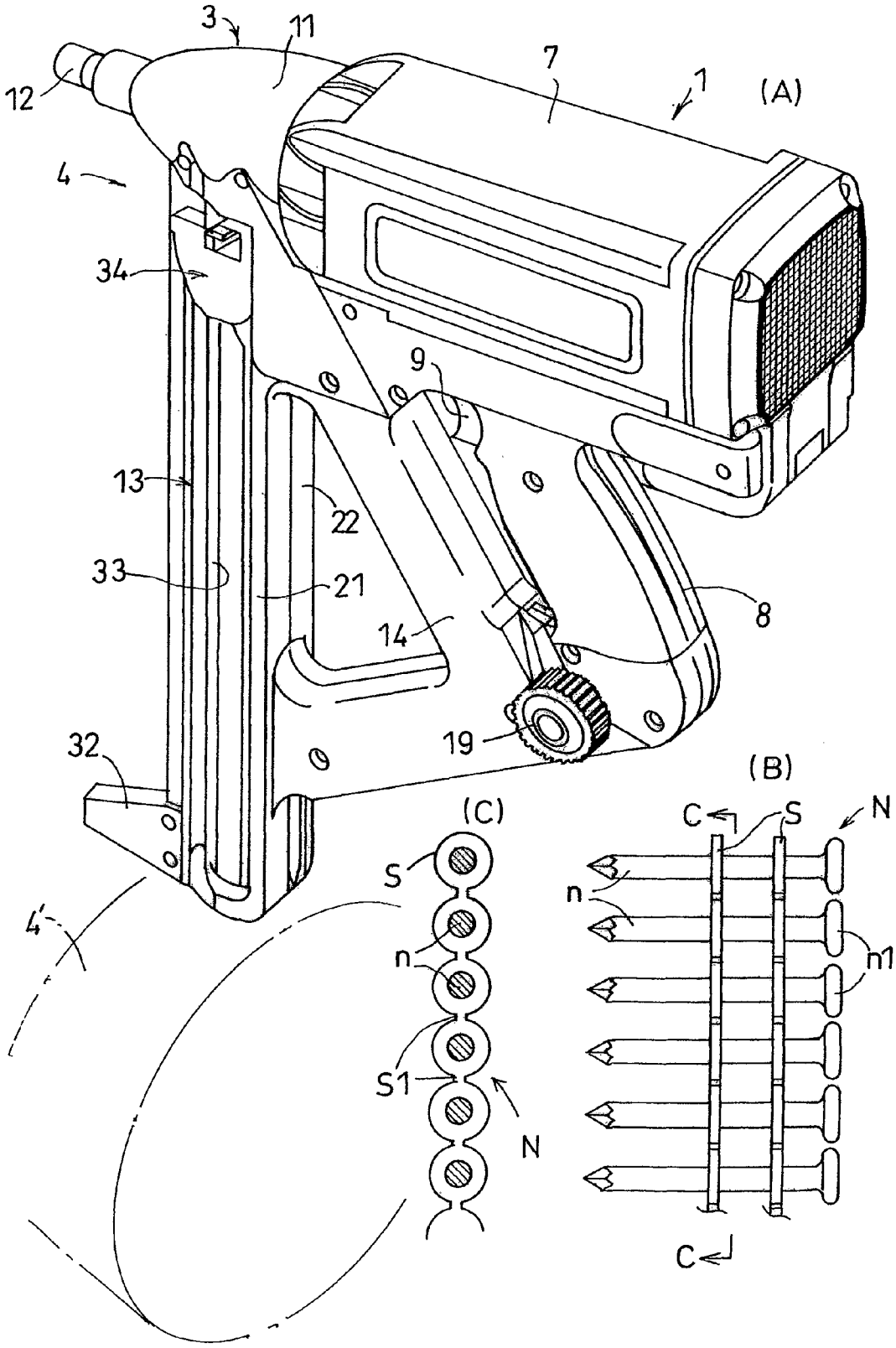

The present application is a National Phase entry of International Application Number PCT/IB2005/001128, filed Apr. 27, 2005, which claims priority from, Japanese Application Number 2004-136415, filed Apr. 30, 2004, the disclosure of which is hereby incorporated by reference herein in its entirety.

TECHNICAL FIELD

The invention in the present application relates to a portable type fastener driving tool such as a nail driving device and to a fastener magazine.

TECHNOLOGICAL BACKGROUND

Nail driving devices such as portable type driving tools are frequently used. This nail driving device is provided with (a) a main body part which has built into it a reciprocally moving piston and is provided with a grip; (b) a head part which is used to guide a driving rod (also known as a hammer blade) which is disposed on the piston; and (c) a magazine which is attached to the head part-all as principal elements. The nail driving device can carry out nail driving operations continuously by feeding nail connecting bodies which are loaded onto the magazine at the front of the rod using a feed means.

The nail connecting body is made by connecting multiple nails using a connecting material so that they are arranged parallel to one another. A metal wire material and resinous tape, a resin holder or paper and the like may be used as a connecting material.

There are also two types of nail connecting body: one type ("coil nail") which uses a connecting material whose overall shape can be altered and which can be wound into a coil shape; and the other type in which the entire body is a rigid body whose shape is virtually unchanged. The magazine which loads the coil nail is drum-shaped while the magazine which loads the rigid body nail connecting body is hollow and has a slender elongated shape. A guide groove which loads the nail connecting body is formed so that it extends in a straight line.

The coil nail feed means has a feed pawl which moves reciprocally due to a motive power driving force. The feed pawl is disposed near the rod and nails which are positioned at the start terminal of the coil nail are feed so that the entire nail connecting body is fed in one pitch increments. This means that the coil nails are fed in one pitch increments by the pulling action from the start terminal.

On the other hand, the rigid body nail connecting body can feed the entire piece by pushing the end terminal. As a result, a feed member ("follower") which pushes the nail connecting body from the end terminal is attached so that it can slide freely and the feed member is pulled to the side of the rod by a spring such as a spring shaped rated output spring.

On the other hand, the nail driving devices generally used can be classified into two types based on the piston drive source: the air tool which uses compressed air and the gas tool which uses gas combustion pressure. The gas tool is advantageous in that it does not require an air compressor so that the nail driving operations can be carried out anywhere and it has outstanding mobility. Since no hose is connected, it has outstanding operability.

Thus, the rigid body nail connecting device is used especially with the gas tool. This is because the rigid body nail connecting body can carry out the feed process using a spring which does not require a special motive force. On the other hand, when an air tool is used, compressed air can be used as a motive power source for the feed means for the nail connecting body so that coil nails are often used (rigid body nail connecting bodies are also oftentimes used).

DISCLOSURE OF THE INVENTION

Problems which the Present Invention is Intended to Solve

The feed means which drives the feed member with a spring has a simple structure and seldom breaks down. Not only that, it is advantageous in that it can be used without regard for the gas tool and the explosive type tool and the air tool and other driving motor forces. On the other hand, however, the end terminal of the nail connecting body is pushed using a feed member and there are limits on the length of the length of the magazine considering the operability and the weight (in other words, there are limits on the movement stroke of the feed member). As a result, there are problems in that there is a limit on the number of nails which are in a single nail connecting body and a nail connecting body with an extremely large number of nails such as a coil nail cannot be used.

When loading operations for the nail connecting body are carried out like the nail driving operations which made use of a stepladder or trestle, most operators want to load as many nails as possible on the magazine. In this case, when nail connecting bodies which are being used remain in the magazine, it is convenient to add new nail connecting bodies to these. However, when a magazine is used which is provided with the conventional spring drive type feed means. Once the nail connecting bodies are loaded, unless these are used or removed, new nail connecting bodies cannot be loaded so that there were problems in that it was not possible to meet the demand for adding new nail connecting bodies.

In addition, when the nail connecting bodies are changed in operations which use nails with different lengths, when nail connecting bodies remain in the magazine, they are removed from the it, however, when the conventional drive type feed means is used, the feed member must be made to go backwards so that there are problems in that replacing the nail connecting body is troublesome.

It is an object of the invention in the present application to improve these conditions.

The invention in the present application relates to a magazine wherein fastener connecting bodies—which are connected so that multiple fasteners are arranged parallel to one another—are loaded and are fed one by one to the front part of a driving rod other and which is provided with (a) a rectilinear loading part which loads the aforementioned fastener connecting bodies so that they extend in a straight line; and (b) a feed member which feeds the fasteners which have been loaded onto the aforementioned rectilinear loading part towards the front part of the aforementioned rod.

Then, the aforementioned feed member is attached to the aforementioned rectilinear loading part so that it can slide easily and so that it can move easily in the direction in which the fasteners are arranged in the fastener connecting body. At the same time, it is energized by a spring means so that it can move freely to the side of the aforementioned rod. A feed pawl which is used to feed the fastener connecting bodies by moving said feed member is disposed so that its position can be changed at will to (a) a latching state wherein any of the fasteners in the feed member can be pushed to the side of the rod and to (b) a latching release state wherein it becomes separated from the fastener.

The invention in the present application includes a driving tool which is provided with the aforementioned magazine. Further, the invention in the present application is suitable for tools such as a gas tool and an explosive tool which inherently do not have a drive motive power source for the fastener connecting body. Needless to say, however, it can also be applied to an air tool and an electric powered driving tool. The term "fastener" covers a wide area of objects which are driven into a workpiece by the force of the rod and includes nails (or pins with a head attached) or tacks which have a head on the base terminal of the shaft with a sharp front end or tackers which are shaped like a box with the left hand side removed and the like.

In the invention in the present application, the feed pawl of the feed member can be attached and detached from any fastener on the fastener connecting body. In other words, the fastener connecting body can be pushed from any part of the lengthwise direction (direction in which the fasteners are arranged).

As a result, even if a fastener connecting body is used which has an extremely large number of connecting bodies which are longer overall than the rectilinear loading part, once the feed member has moved completely to the end terminal of the side of the rod, it returns to the start terminal part which is opposite it and the feed pawl is latched onto the fastener of the fastener connecting body and the fastener connecting bodies are fed by repeating this operation over and over again.

This means that fastener connecting bodies which have an extremely larger number of connecting bodies can be fed without increasing the movement stroke of the feed member. As a result, the fastener connecting body need not be replaced as often and the efficiency of the driving operations can be improved.

New fastener connecting bodies may be loaded while the fastener connecting bodies which are being used midway in operations are still remaining in the magazine. This means that new fastener connecting bodies can be added to the magazine thus improving the operability of the driving operations.

In addition, when the fastener connecting bodies are removed from the magazine to replace the fastener connecting bodies, all one has to do is change the feed pawl to latching and release mode even if the individual feed members are not returned to the end terminal part. As a result, this is advantageous in that the fastener connecting body sampling operations can be carried out quickly and easily.

In addition, the magazine in the invention in the present application is such that the type of fastener connecting body which feeds from the end terminal part using the feed member like the prior art rigid body nail connecting body can be used as is. Since a variety of modes of fastener connecting bodies can be used, the ability to use the nail driving device at will as one wants is considerably upgraded.

Next, we shall explain modes of carrying out the invention in the present application based on figures. FIG. 1 through FIG. 10 are for the first mode of carrying out the present invention.

FIG. 1 FIG. 1 (A) Inclined view of the nail driving device seen from the rear. FIG. 1 (B) and FIG. 1 (C) Diagrams indicating the nail connecting body.

Figure 2:
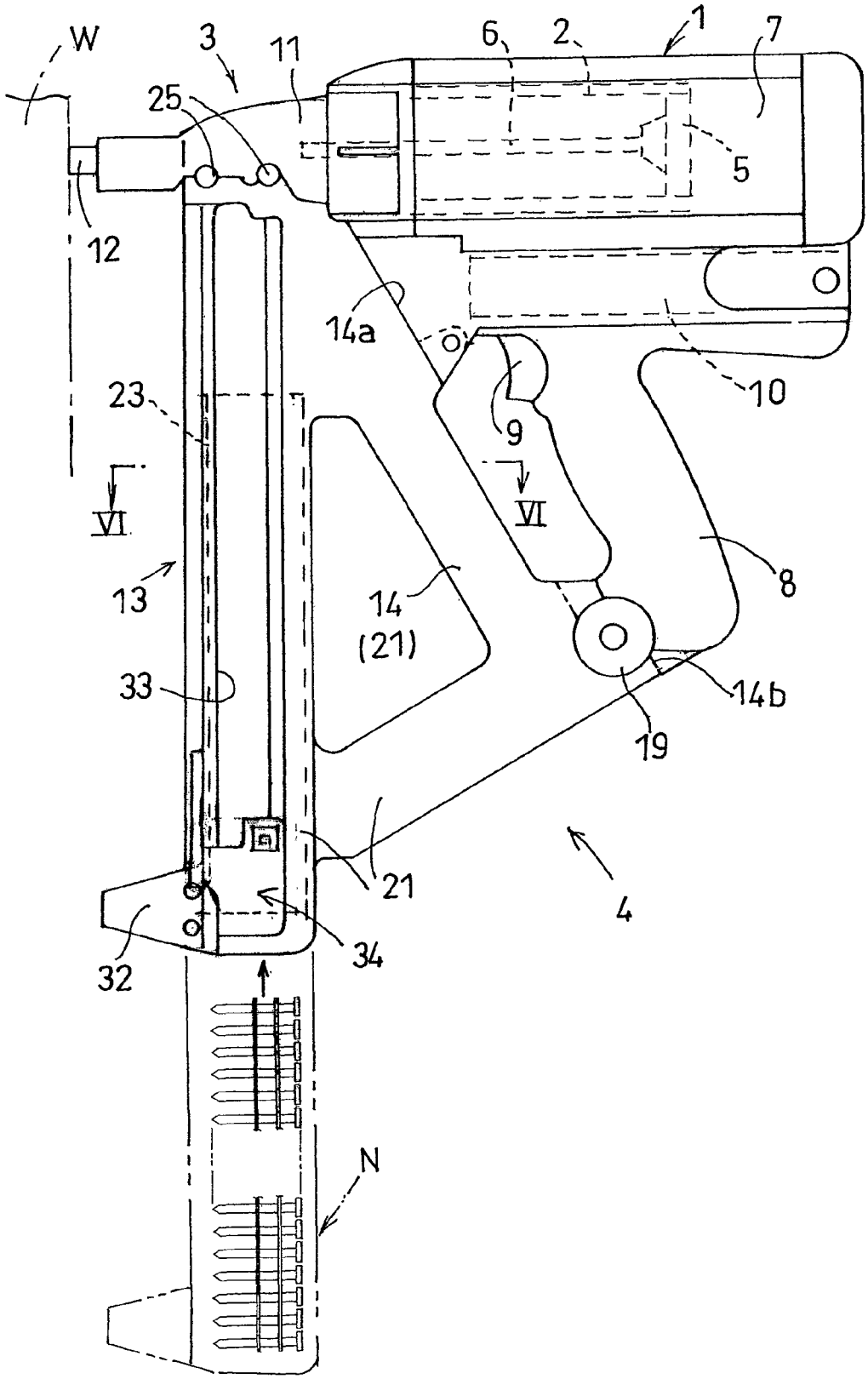

FIG. 2 Lateral view of the nail driving device.

Figure 3:
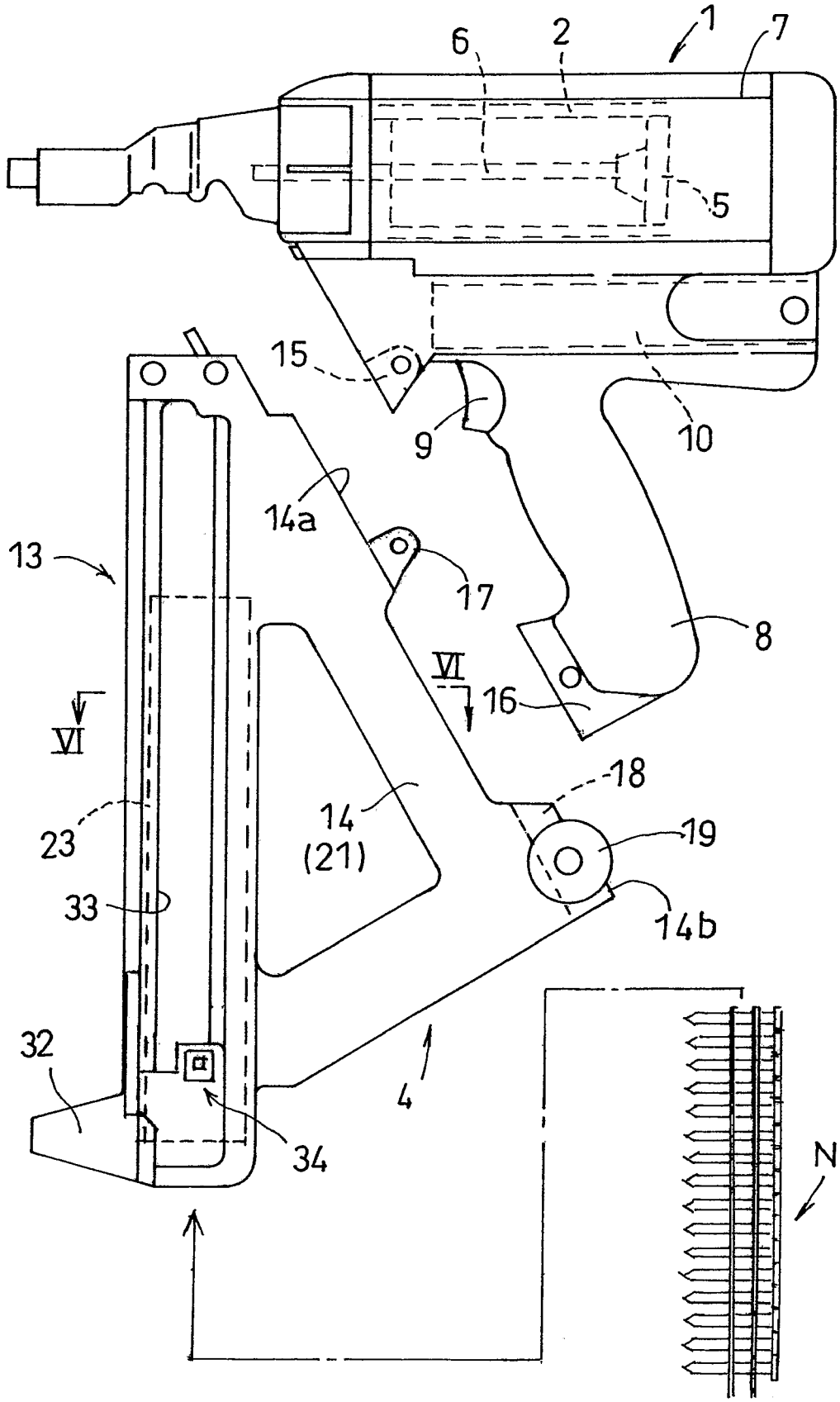

FIG. 3 Lateral view of the nail driving device when separated from the magazine.

Figure 4:
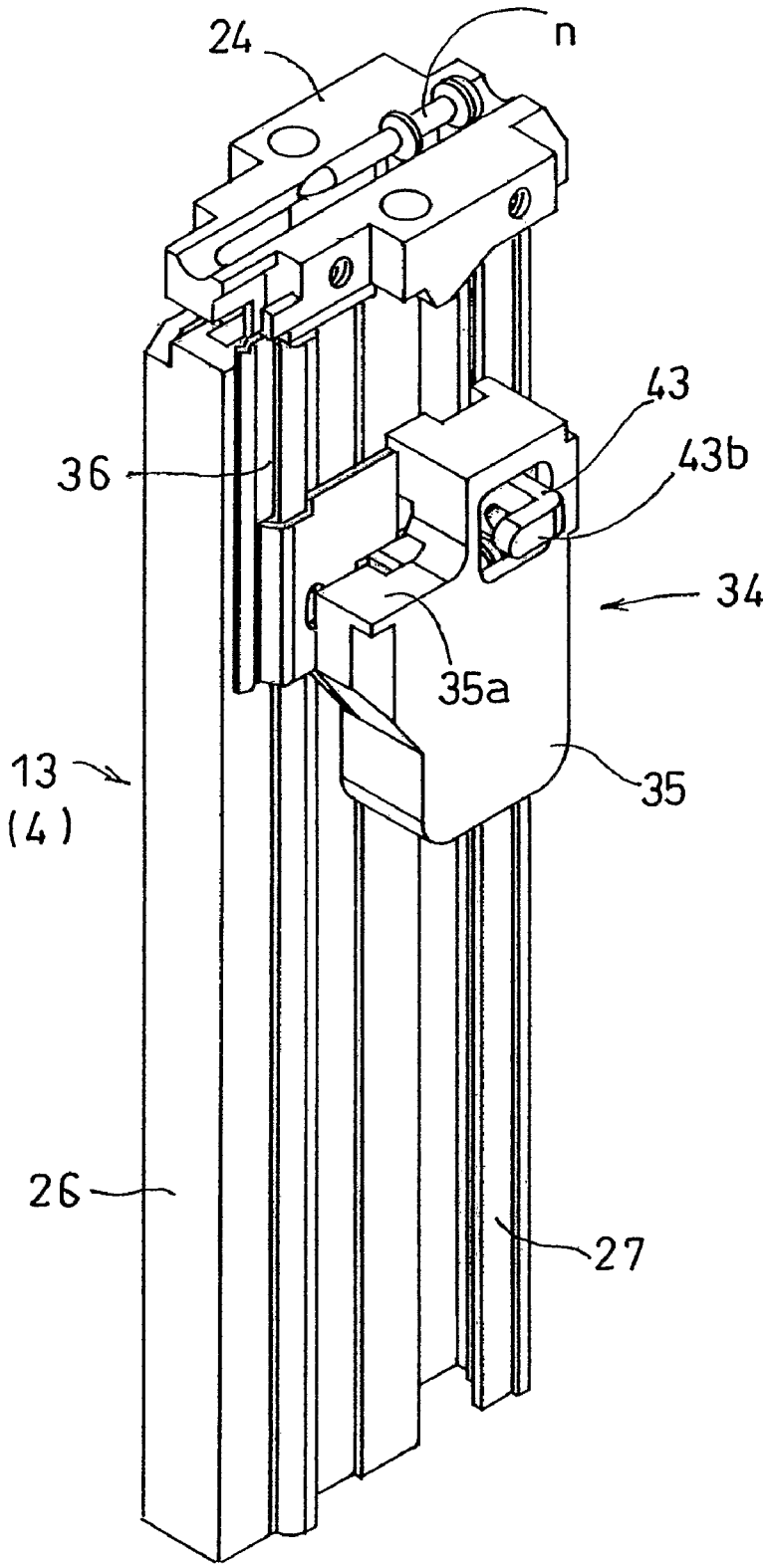

FIG. 4 Exploded inclined view of the member with part of it omitted.

Figure 5:
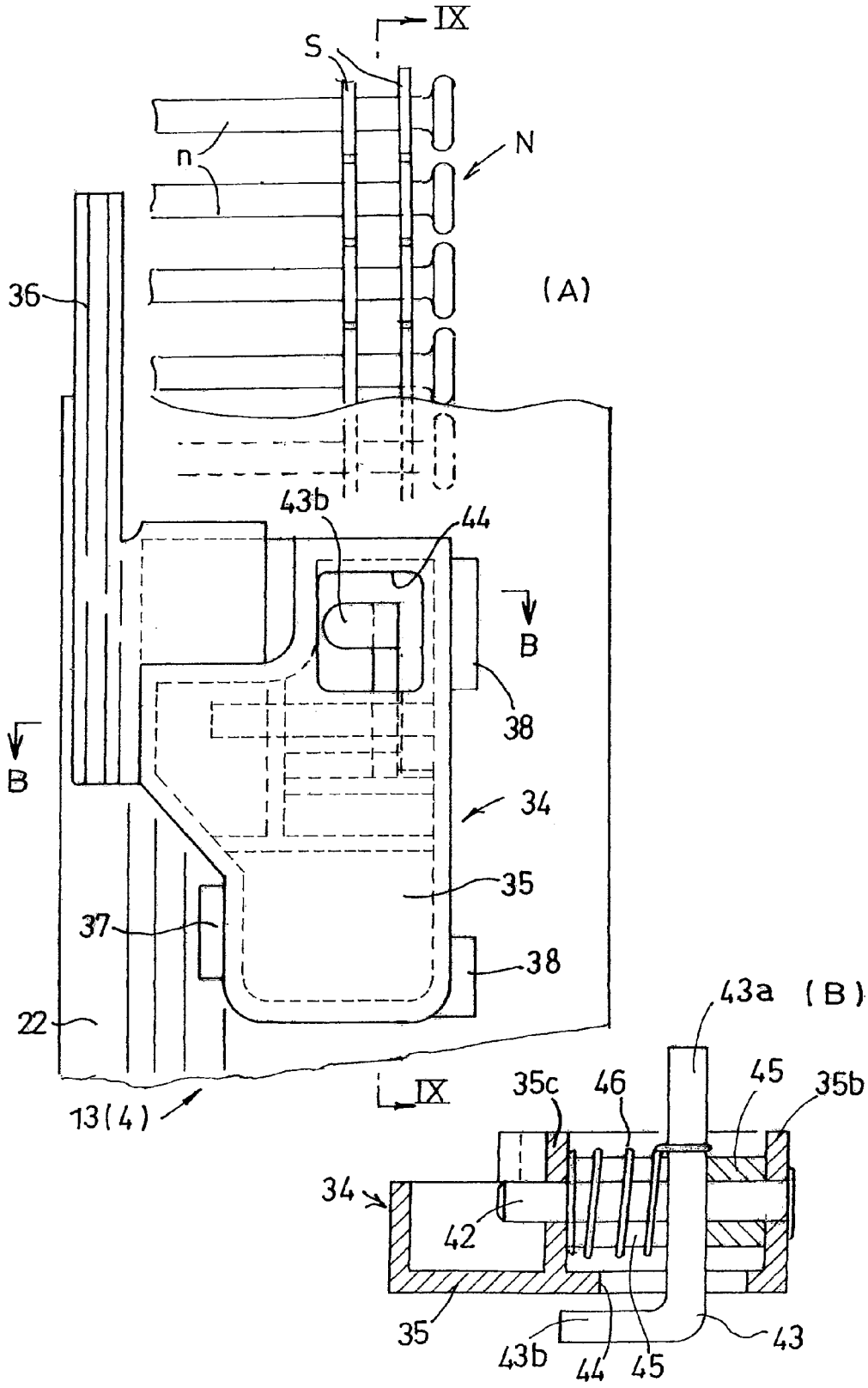

FIG. 5 (A) Lateral view of the magazine with part of it omitted.

FIG. 5 (B) Sectional view of FIG. 5 (A) seen along B-B.

Figure 6:
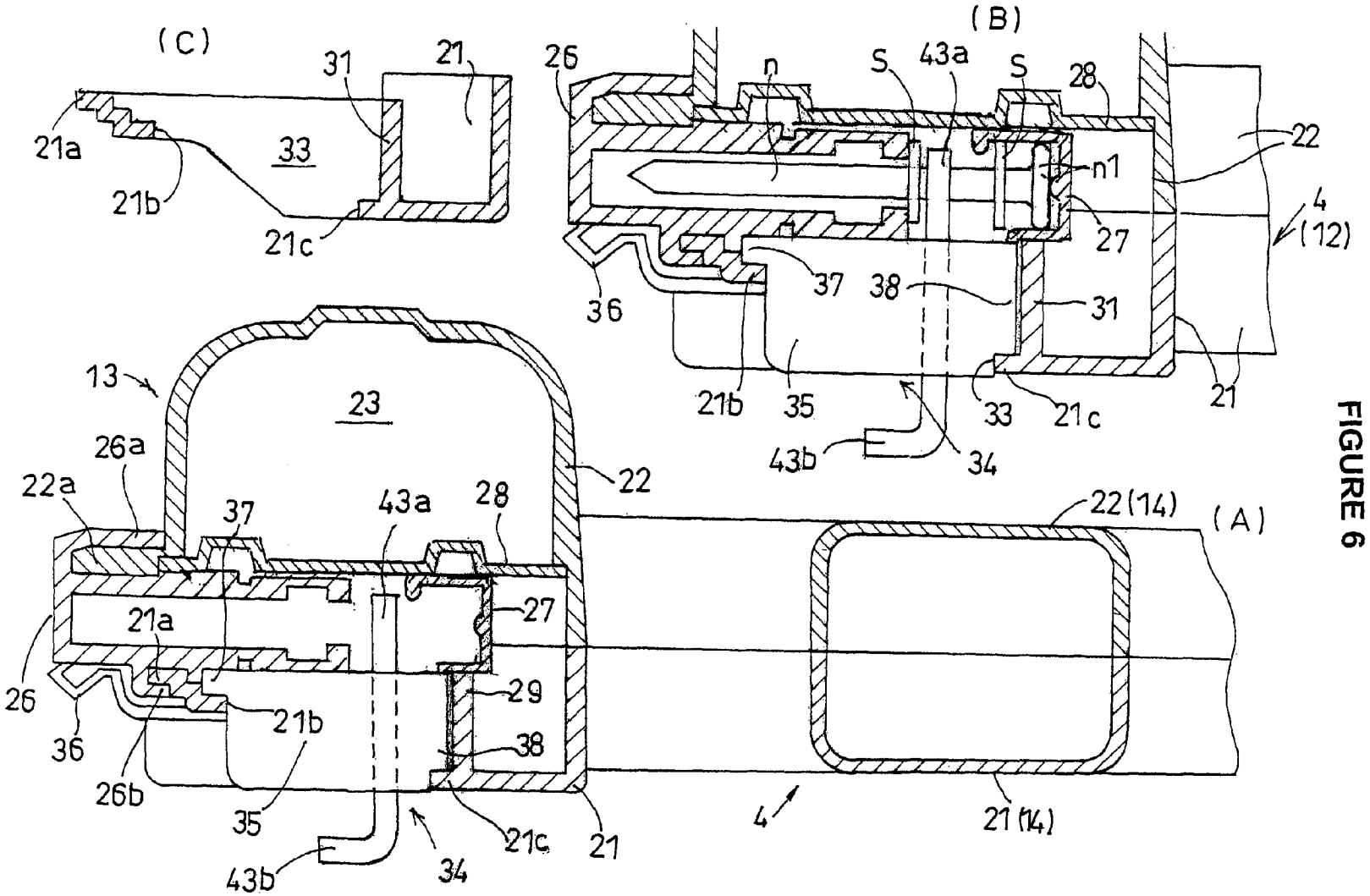

FIG. 6 (A) and FIG. 6 (B) Sectional views of FIG. 2 and FIG. 3 seen along VI-VI. FIG. 6 (C) Partial plane sectional view of the left casing.

Figure 7:
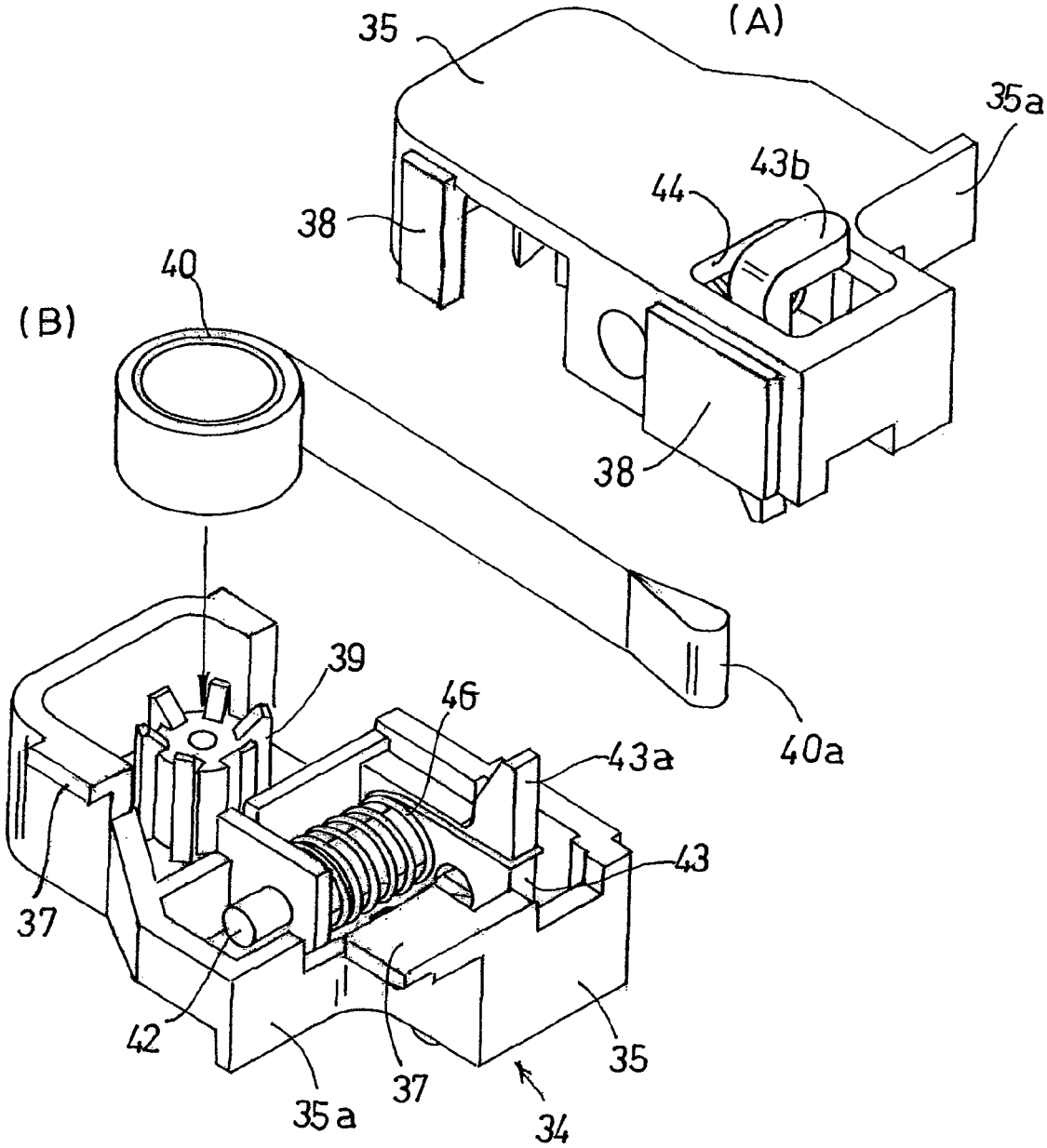

FIG. 7 Inclined view of the feed member.

Figure 8:
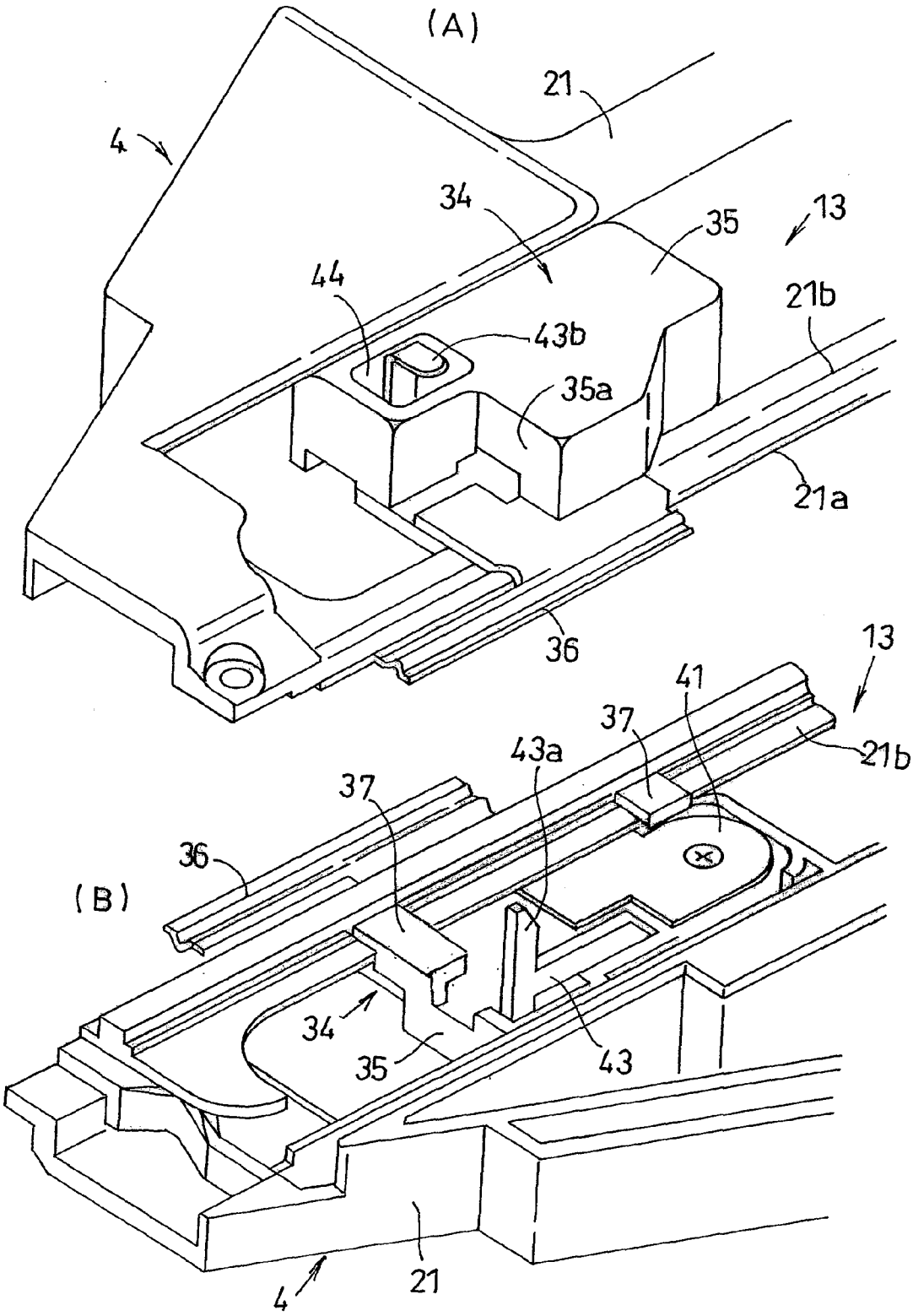

FIG. 8 A partial inclined view of the feed member when it is attached.

Figure 9:
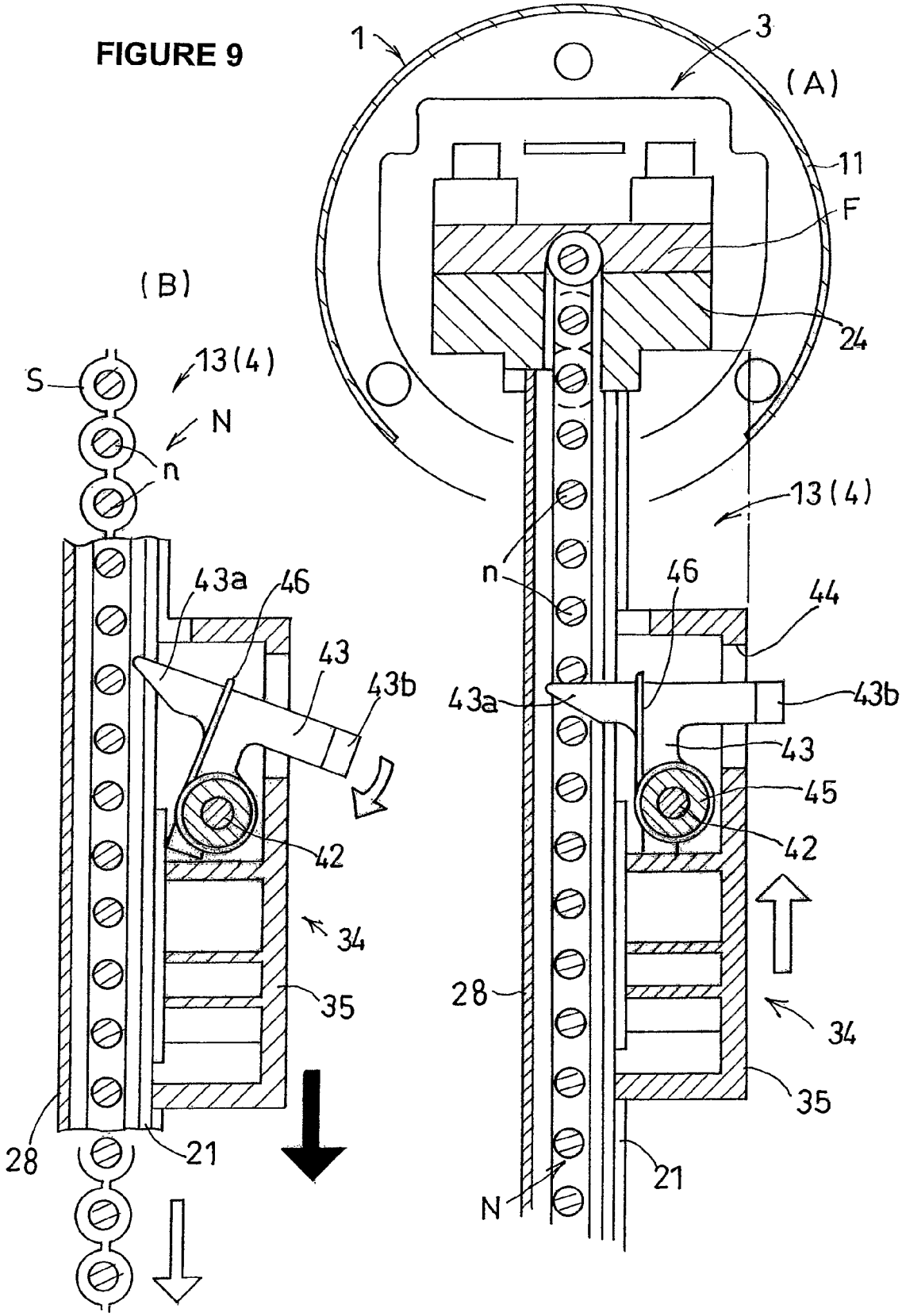

FIG. 9 A sectional view of FIG. 5 (A) seen along IX-IX.

(1) OVERVIEW

First, we shall provide an overview based on FIG. 1 to FIG. 3. FIG. 1 (A) is an inclined view of the nail driving device seen from the rear. FIG. 1 (B) is a partial lateral view of the nail connecting body N used in the nail driving device. FIG. 1 (C) is a sectional view of FIG. 1 (B) seen along C-C. FIG. 2 is a lateral view of the nail driving machine. FIG. 3 is a lateral view of the magazine when it is separated.

The nail driving device in the invention in the present application uses gas combustion pressure as a motive force for driving the nails. It is provided with (a) a main body 1 in which is stored a cylinder 1; (b) a head part 3 which is disposed on the front end part of the main body 1; (c) and a magazine 4 which is attached to the head part 3 and the main body 1 so that it can be easily attached and detached. A piston 5 is inserted in the cylinder 2 so that it can slide easily. A rod 6 which advances a great distance from the main body 1 is used to drive the nails n into the workpiece W.

Cylinder 2 is covered by a housing 7 which configures the main body 1. The main body 1 is also provided with a grip 8. A trigger 9 is disposed on the grip 8. A hollow fuel cell chamber 10 is formed between the cylinder 2 and the grip 8 on the main body 1. A gas cartridge (bas cylinder) is loaded in this fuel cell chamber 10.

In explaining (specifically) the structure of this mode of carrying out the present invention the terms "front and rear", "left and right" and "upward and downward" are used. However, the directions front and rear, left and right and upward and downward are based on the direction seen by the person holding the nail driving device when the rod 6 is schematically horizontal. In other words, front and rear, left and right and upward and downward are based on the position for driving the nail into the wall. Quite naturally, the direction is different when nails are being driven into the ceiling or into the floor.

The head part 3 is provided with a front nose (see F in FIG. 10) which guides the rod 6 and the nail n. The front nose is attached to the front end of the main body 1. The front nose is covered by the cover (shroud) 11. The head part 3 is also provided with a lower probe 12 which makes up part of the safety device. The front end part of the lower probe 12 is exposed from the cover 11. When the lower probe 12 is pushed into the workpiece W, the lock on the safety device is released and the trigger 9 can be pulled.

(2). OVERVIEW OF MAGAZINE

Next, we shall provided a schematic overview of the magazine 4 by referring to FIG. 4. FIG. 4 is an inclined view of the magazine 4 with part of the member omitted. The magazine 4 is provided with (a) a rectilinear loading part 13 which extends upward and downward so that it is perpendicular to the shaft line of the rod 6; and (b) an auxiliary loading part 14 which is disposed so that it forms an integral piece with the rear end part of the rectilinear loading part 13. The rear surface of the auxiliary loading part 14 becomes slanted parts 14*a* and 14*b* which slant to the front when seen from the side. In addition, the upper part and the lower part of the auxiliary loading part 14 is connected to the rectilinear loading part 13 and form a letter "v" stood on one end when seen from the side (needless to say, other shapes are permitted as well).

On the other hand, an upper overlapping part 15 and a lower overlapping part 16 which slant so that part of the top of the grip 8 on the front surface of the main body 1 and the lower part of the grip 8 overlap on the slanted parts 14*a* and 14*b* on the auxiliary loading part 14 in the magazine 4 are formed. Meanwhile, upper and lower stopper parts 17 and 18 which fit into the upper and lower overlapping parts 15 and 16 which are formed on the main body 1 are formed on the upper and lower slanted parts 14*a* and 14*b* of the auxiliary loading part in the magazine 4. The lower stopper part 18 and the lower overlapping part 16 are fixed by a screw with attached knob 19.

Further, the magazine 4 does not require an auxiliary loading part 14 by any means and may be equipped with only a rectilinear loading part 13. In addition, the rectilinear loading part 13 may be the long type which extends downward from the bottom end of the auxiliary loading part 14, as indicated by the two dot chain line in FIG. 2.

As indicated in FIG. 1 (B) and FIG. 1 (C), the nail connecting body N is shaped by connecting multiple nails n which are arranged so that they are parallel to one another using two sheet form connecting materials S. The sheet form connecting material S is shaped so that the head n1 of the nail n and the ring part which has the same radius are connected via the bridge part S1. The bridge part S1 is broken when the nail n is driven.

In this mode of carrying out the present invention, in the nail connecting body N, the direction in which the connecting material S extends is perpendicular to the shaft line of each of the nails n. The head n1 of the nails n which are adjacent is arranged so that the axial direction is the same, however, the adjacent nails n are shifted bit by bit in the axial direction (this mode is often used to reduce the number of connecting pitches for the nails). In this case, the rectilinear loading part 13 of the magazine 4 assumes a slanted position which slants forward—when seen from the side—relative to the shaft line of the rod 6.

(3). BASIC STRUCTURE OF MAGAZINE

Next, we shall describe the basic structure of the magazine referring to FIG. 5 and FIG. 6 in addition to the previous figures. FIG. 5 (A) is a partial lateral view of the magazine 4 when part of the member is omitted. FIG. 5 (B) is a sectional view of FIG. 5 (A) seen along B-B. FIG. 6 (A) and FIG. 6 (B) are sectional views of FIG. 2 and FIG. 3 seen along VI-VI. FIG. 6 (A) is a diagram indicating an abbreviated form of the nail connecting body N. FIG. 6 (B) is a diagram indicating an abbreviated form of the nail connecting body N.

As can be seen clearly in FIG. 6 and FIG. 1, the magazine 4 is provided with a pair—left and right—of casings 21 and 22 which make up the magazine 4. The left and right magazines 21 and 22 open in a direction where they face each other. As a result, the magazine 4 is completely hollow.

The end surfaces of the left and right casings 21 and 22 overlap one another with the exception of the front part of the rectilinear loading part 13. The aforementioned auxiliary loading part 14 is configured solely of the casings 21 and 22. A vertically long battery chamber 23 is formed so that it bulges to the right at a location on the rectilinear loading part 13 on the right casing 22 which is positioned to the right seen from the vantage point of the operator. Needless to say, the battery chamber 23 need not be disposed in the magazine 4.

In addition, a share block 24 (see FIG. 4) is fixed on the upper end part of the right casing 22 and a long hole which opens vertically through which the nail n passes is located on the share block 24. This share block 24 overlaps with the aforementioned nose piece. The upper end part of the left casing 21 is fixed to the share block by the screw 25 (see FIG. 2 and FIG. 3). Further, the left and right casings 21 and 22 are indicated in abbreviated form in FIG. 4.

As indicated in FIG. 6, the rectilinear loading part 13 of the magazine 4 is provided with a pair of rails 26 and 27 in front and in back which guide the nail connecting body N. The front and back rails 26 and 27 are shaped like a bucket which opens so that they face each other and are disposed by placing a certain interval between them.

The rear part rail 27 is primarily formed so that there is a short width on the front and on the back so that the head n1 of the nail n is guided. Meanwhile, the front part rail 26 has a long width on the front and the back. The connecting agent S which is positioned on the side of the head n1 of the nail n in the two connecting materials S of the nail connecting body N is surrounded by the rear part rail 27. The connecting agent S which is positioned on the front end of the nail n is disposed so that it overlaps with the rear end surface of the front part rail 26.

A dual purpose cover plate 28 which serves as a partition for the battery chamber 36 is inserted in the opening part of the right casing 22 so that it does not slip out of place. The front and the rear rails 26 and 27 are pressed and retained so that they cannot fall out of place—either in the front or the back—by this cover plate 28 and the left casing 21. The cover plate 28 is formed so that it has an uneven surface when seen on a plane. In addition, a vertical rib 29 which is used to press the rear part rail 27 is formed on the left casing 21.

Front facing front flanges 21*a* and 22*a* are formed on the front end of the left and right casings 21 and 22. Meanwhile, the left and right sack parts 26*a* and 26*b* which embrace the aforementioned front flanges 21*a* and 22*a* are formed respectively on the front part rail 26. As a result, the left and right casings 21 and 22 and the front part rail 26 are retained on the front part so that the left and right casings do not become separated from one another and so that they do not fall out of place.

In addition, the rear part rail 27 is clamped on the front and back by both casings 21 and 22 so that it does not fall out of place. As indicated in FIG. 1 through FIG. 3, the foot 32 which makes contact with the surface of the workpiece W is attached to the lower end part of the front part rail 26 so that it can be attached and detached at will.

A vertically long window hole 33 (see FIG. 2 and FIG. 3) is opened on the location of the rectilinear loading part 13 of the left casing 21. A feed member 34 (follower) is exposed from this window hole 33. The feed member 34 is retained by the front and back rails 26 and 27 and the left casing 21 so that it can slide up and down freely. The nail connecting body N is fed by the feed member 34. We shall explain this feed member 34 by referring to FIG. 7 and the figures thereafter in addition to the previous figures.

(4) FEED MEMBER

FIG. 7 (A) is an inclined view of the feed member 34 seen from the surface. FIG. 7 (B) is an inclined view of the same when it is turned inside out. FIG. 9 is a sectional view of FIG.

6 (A) seen along IX-IX. FIG. 9 (A) is a diagram indicating the latching state. FIG. 9 (B) is a diagram indicating the state when the latching is released.

The feed member 34 is provided with a case shaped slider 35 which opens in the direction of the side of the nail connecting body N. Most of this slider 35 is exposed to the outside so that the operator can move it and operate it manually. In addition, a step piece 35*a* which opens upward and toward the front is formed on the slider 35 so that it can be lowered by pushing it down with the finger by applying the finger to this step part 35*a*. The lower part of the step mart 35*a* protrudes so that it overlaps with the outside surface of the front end part of the left casing 21.

A metal plate lock out bracket 36 which extends upward and downward along the surface of the front part rails 26 and 27 is anchored to the slider 35. In addition, the slider 35 overlaps with the outside surface of the front and rear rails 26 and 27 so that it can slide freely.

As indicated in FIG. 6 (C), the left casing 21 has a double level shape so that the left and right widths are thick on the rear part and thin on the front part. The front and rear edges of the window hole 33 are formed respectively by the front and rear guide flanges 21*b* and 21*c*. Meanwhile, as indicated in FIG. 6 (B) and FIG. 6 (C), front and rear protrusions (step parts) 37 and 38 which face the outside which are pushed by the guide flanges 21*b* and 21*c* of the left casing 21 are formed on the slider 35. As a result, the feed member 34 is retained on the front and rear and on the left and right so that it can slide only upwards and downwards and cannot fall out (see FIG. 7 and FIG. 8 (B)).

As indicated in FIG. 7 (B), a schematic gear shaped spring bearing 39 whose shaft line extends to the left and right is disposed inside the empty space on the slider 35. A spring shaped rated output spring 40 which is an example of the spring means is wound around this spring bearing 39 and is fixed to one end of it. The other end 40*a* of the rated output spring 40 is shaped like a loop and it latches onto the upper part of the left casing 21. As a result, the feed member 34 is always oriented and pulled toward the head part 3 by the elasticity of the rated output spring 40. 41 in FIG. 8 (B) is the cover part which stops the rated output spring 40 and it forms an integral piece with the lock out bracket 36.

As indicated in FIG. 5, FIG. 7 and FIG. 9, a feed pawl 43 is attached to the slider 35 via a pin 42 which extends both to the front and to the back so that it can move freely. The pin 42 passes through the side plate 35*b* and the rib 35*c* of the slider 35. The feed pawl 43 is provided with a pawl part 43*a* which fits into and can be detached from the space between the adjacent nails n on the nail connecting body N as it turns around the shaft center of the pin 42. The feed pawl 43 is also provided with an operating part 43*b* which is exposed to the outside from the hole 44 which is formed on the slider 35.

A collar 45 (may be replaced by a nut and washer) is inserted into both sides which clamp the feed pawl 43 on the pin 42. A dual purpose compression torsion spring 46 fits into the collar 45 which is positioned on the side of the rib 35*c*. One end of this makes contact with the rib 35*c* of the slider 35 and the other end is caught on the pawl part 43*a* of the feed pawl 43. The feed pawl 43 is energized by the position at which the nail connecting body N is caught by this dual purpose compression torsion spring 46 and it is energized toward the side plate 35*b* of the slider 35. Further, the slider 35 may be made of resin or of sheet metal.

(5) SUMMARY

As has already been seen from FIG. 9, the feed pawl 43 can latch (brought into contact from the bottom) onto any nail n of the nail connecting body N. In addition, the feed pawl 43*a* can escape from the nail n at will relative to the downward motion of the slider 35 so that the feed pawl 43*a* can automatically latch onto and be released from the group of nails n by moving the slider 35 downward with the hand.

As a result, another new nail connecting body N may be added while [the old one is] being used by pushing from the lower end of the nail connecting body N using the feed member 34. In addition, the lower end (end terminal) of the nail connecting body N can be pushed so that the nail connecting body N which uses paper tape as a connecting material can be used without any difficulties.

Further, the feed pawl 43 which pushes the operating part 43*b* downward is in a latching release position whereby it is separated from the nail connecting body N so that the slider 35 can be moved while the feed pawl 43 is being turned and operated.

In addition, even if it is a long nail connecting body N with a long connection such that it protrudes from the lower end of the magazine 4, the feed pawl 43 can be latched onto the nail n which is positioned at a location where the feed member 34 is lowered as far as the lower end (start terminal) until it has moved completely to the upper end (end terminal), this being the sequence whereby the nail connecting bodies N can be fed reliably.

As a result, as indicated by the dot and chain line in FIG. 1, a nail connecting body with an extremely long connecting length can be used by attaching a drum-shaped magazine 4' to the lower end of the rectilinear loading part 13. Further, the drum-shaped magazine 4' may be attached to the rectilinear loading part 13 so that it can be attached and detached and it may be attached so that it forms an integral body with it [the loading part].

Further, if there is enough of an interval between the adjacent nails n for the pawl part 43*a* of the feed pawl 43 to be inserted and detached to latch and detach the feed pawl 43 from any nail n, any nail connecting body N whatsoever can be fed.

However, when the feed pawl 43 rattles in the axial direction of the pin 42, problems arise in that the pawl part 43*a* interferes with the connecting substance S. Although the collar 45 should be processed precisely and the feed pawl 43 should be retained so that there is no rattling, the process itself for this is time-consuming.

On the other hand, when a dual purpose compression torsion spring 46 which is provided with (a) a compression function; and (b) a coil shaft center rotation torsion function as an energizing function for the feed pawl 43 is used, it is advantageous in that the feed pawl 43 is always pressed to one of the sides so that the feed pawl 43 can be retained to a constant position even if the collar 45 is not painstakingly processed. In other words, the feel pawl 43 can retain the position so that it is constant using the energizing spring for the latching position.

(6) OTHER

The invention in the present application may be realized in other modes besides those indicated previously. For example, the spring means which drives the feed member need not necessarily be restricted to a rated output spring and an extension spring and rubber and the like may also be used. In addition, needless to say, the mode of the feed member may be changed should the need arise. The fasteners may also be pushed with a feed pawl at multiple locations along the shaft direction.

In addition, the feed member may be retained on a provisional basis on the start end part (or any location) of the reciprocating path. The feed pawl may also be retained in a latching and releasing state.

The invention claimed is:

1. A magazine assembly configured to feed fasteners connected in parallel to one another, one by one to a driving rod, comprising:

a rectilinear loading part; and a feed member slideably attached to the rectilinear loading part and configured to move freely in a direction in which the fasteners are arranged, the feed member including:

a case shaped slider;

a gear shaped spring bearing and a spring wound around the spring bearing, one end of the spring fixed to the spring bearing and the other end of the spring affixed to an upper part of the rectilinear loading part; and a feed pawl pinned to the slider, the feed pawl having a pawl part configured to fit into a space between adjacent fasteners.

2. The magazine assembly, accordingly to claim 1, wherein the slider has a hole disposed on a side opposite a side facing the connected fasteners, and the feed pawl has an operating part in-line with the pawl part and extending through the hole.

3. A driving tool, comprising:

a main body, the main body including:

a housing;

a cylinder disposed within the housing;

a piston slideably inserted in the cylinder; and a driving rod affixed to the piston, the rod configured to drive fasteners into a workpiece;

a head part disposed on a front part of the main body; and a magazine assembly configured to feed fasteners, connected in parallel to one another, one by one to the front of the driving rod, comprising:

a rectilinear loading part; and a feed member slideably attached to the rectilinear loading part and configured to move freely in a direction in which the fasteners are arranged, the feed member including:

a case shaped slider;

a gear shaped spring bearing and a spring wound around the spring bearing, one end of the spring fixed to the spring bearing and the other end of the spring affixed to an upper part of the rectilinear loading part; and a feed pawl pinned to the slider, the feed pawl having a pawl part configured to be fit into a space between adjacent fasteners.

* * * * *